US005887373A

United States Patent [19]

Byers

[11] Patent Number: 5,887,373

[45] Date of Patent: Mar. 30, 1999

[54] CARD DISPLAY FRAME

[76] Inventor: Thomas L. Byers, 5480 Stewart Dr., Mustang, Okla. 73064

[21] Appl. No.: 370,867

[22] Filed: Jan. 10, 1995

[51] Int. Cl.[6] ..... A47G 1/06

[52] U.S. Cl. ..... 40/733; 40/734; 40/605; 40/781

[58] Field of Search ..... 40/154, 124.2, 40/642, 647, 661, 605, 729, 730, 733, 781, 780; 206/449, 450; 220/6, 23.4, 662, 684

[56] References Cited

U.S. PATENT DOCUMENTS

| | | | |
|---|---|---|---|
| 224,973 | 2/1880 | Wallis . | |
| 739,019 | 9/1903 | McGinn . | |
| 2,823,472 | 2/1958 | Waller et al. | 40/152 |
| 3,132,432 | 5/1964 | Yee | 40/152.1 |
| 3,292,285 | 12/1966 | Kitayama | 40/733 X |
| 3,339,302 | 9/1967 | Mallory | 40/152 |
| 3,426,913 | 2/1969 | Abatiell, Jr. | 40/605 X |
| 3,428,108 | 2/1969 | Singer | 40/605 X |
| 3,471,959 | 10/1969 | Seger | 40/152 |
| 3,673,724 | 7/1972 | Bell et al. | 40/152 |
| 3,722,122 | 3/1973 | Sesto | 40/152 |
| 3,952,435 | 4/1976 | Olsen | 40/152.1 |
| 4,017,989 | 4/1977 | Murray | 40/152 |
| 4,043,477 | 8/1977 | Deese | 220/23.4 |
| 4,115,938 | 9/1978 | Belmuth et al. | 40/152 |
| 4,261,122 | 4/1981 | LeVine | 40/152 |
| 4,271,618 | 6/1981 | Lyman | 40/661 X |
| 4,330,952 | 5/1982 | Swanson | 40/152.1 X |
| 4,432,152 | 2/1984 | Daenen | 40/152.1 |
| 4,532,727 | 8/1985 | Klose et al. | 40/152 |
| 4,706,397 | 11/1987 | Hesener | 40/152 |
| 4,729,183 | 3/1988 | Tarter et al. | 40/152.1 X |
| 4,912,866 | 4/1990 | Bannister et al. | 40/733 X |
| 4,989,353 | 2/1991 | Astolfi | 40/152.1 |

FOREIGN PATENT DOCUMENTS

| | | | |
|---|---|---|---|
| 391450 | 4/1965 | Switzerland | 40/152.1 |

*Primary Examiner*—Peter M. Cuomo
*Assistant Examiner*—James O. Hansen
*Attorney, Agent, or Firm*—McAfee & Taft

[57] ABSTRACT

A two-sided card frame of a type constructed from resilient modular components, the modular components including top and bottom cap modules and left and right side modules which include in their structure the necessary snap securing configurations for combination to a rectangular card frame bordering window modules that retain the viewable material. Additionally, modules are included to enable stacking and/or hinge alignment of the individual card frames.

15 Claims, 4 Drawing Sheets

CARD DISPLAY FRAME

BACKGROUND OF THE INVENTION

1. Field of the Invention

The invention relates generally to display frames for hobby cards, photographs and the like and, more particularly, but not by way of limitation, it relates to improved manufacture and construction of such display frames.

2. Description of the Prior Art

The prior art includes any number of different types of frame and framing structure that are used for display of photos and other pictorial matter, such framing practice having developed over a long number of years. A search of the prior art does not reveal any prior attempt at elemental modular construction of rectangular-type frames. U.S. Pat. No. 4,432,152 teaches the employ of a modular concept; however, the frame itself is a unitary module while other modular addenda such as hangers and holders are conformed thereto. There is no teaching of modular frame elements per se.

Modular concepts in framing art appear to be in the combining of multiple frames as shown by U.S. Pat. Nos. 4,532,727; 3,471,959; and 3,339,302 with no attention having been given to pre-formed, unitary frame elements for manual assembly into finished frames. Further, there is no teaching of any modular-type plastic frames that are specifically adapted for holding 2½×3½ inch trading cards, i.e., sports star cards, memorial cards and other bubble gum-type collector cards for two-sided viewing, and the particular modular construction includes both hinging and stacking capability for grouping of individual frames.

SUMMARY OF THE INVENTION

The present invention relates to an improved, modular form of card frame that provides two-sided viewing as well as air-exclusive enclosure of the card, photo or the like. The individual frames include top and bottom edge members and opposite side edge members which may be joined rectangularly to seal a card specimen between opposite side window panels. The modular frame includes frame corner securing fixtures as well as finishing modules such as frame inserts, hinge inserts, and stacker inserts which enable a variation of stringing and stacking frame arrangements. The modules are formed by molding of selected resilient plastic so that individual modules may be manually assembled into a secure card frame or plurality of card frames.

Therefore, it is an object of the present invention to provide a manually assemblable enclosure frame for preservation and display of hobby cards.

It is also an object of the present invention to provide a card frame of modular construction that may be used for stacking and/or stringing together a plurality of display card frames.

It is still further an object of the invention to provide a card frame that provides secure and permanent joinder of all individual modular elements of the card frame.

Finally, it is an object of the present invention to provide a two-sided display frame for collectors that is attractive, economical and easily assembled by the card collector into a modular display arrangement of his choosing.

Other objects and advantages of the invention will be evident in the following detailed description when read in conjunction with the accompanying drawings which illustrate the invention.

DETAILED DESCRIPTION OF THE INVENTION

Figure 1:
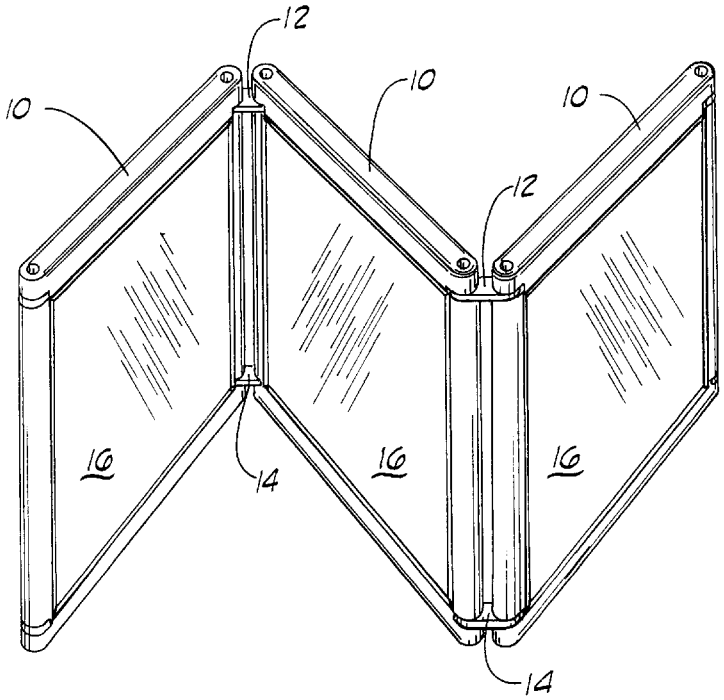
FIG. 1 is a perspective view showing a plurality of card frames linked in side-by-side array.

FIG. 1 illustrates a plurality of card display frames 10 suitably arrayed in a standing configuration by selected positioning of the respective upper and lower hinges 12 and 14. The frames 10 are of modular construction, as will be fully described, and each is adapted to present viewing material in the respective window panels 16. Actually, the window panels 16 are each dual panel modules carrying pictorial and graphic material therebetween and readable from either side of frames 10.

Figure 2:
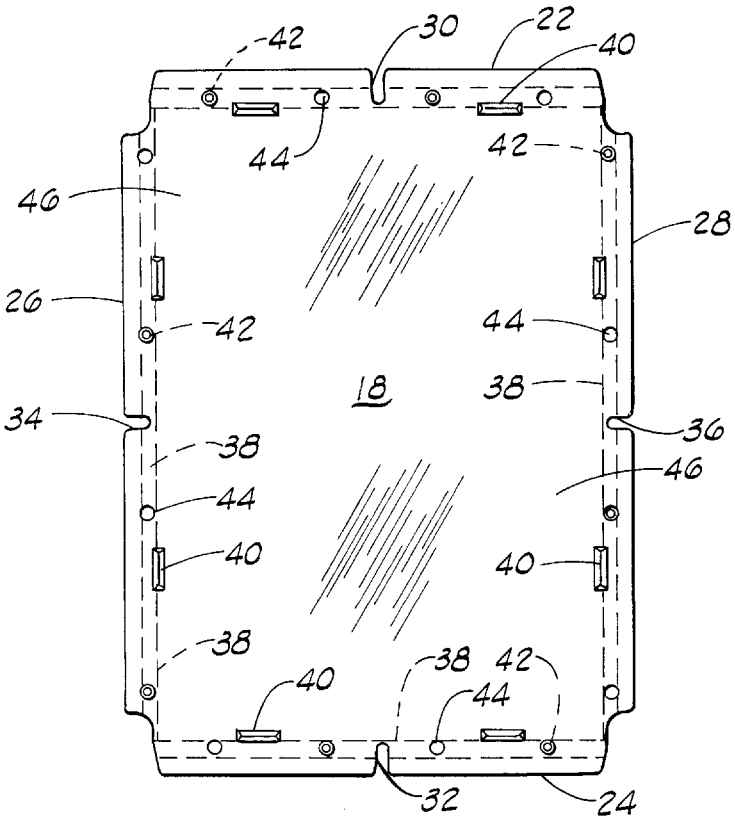
FIG. 2 is a plan view of the outer surface of a first window panel module.
Figure 3:
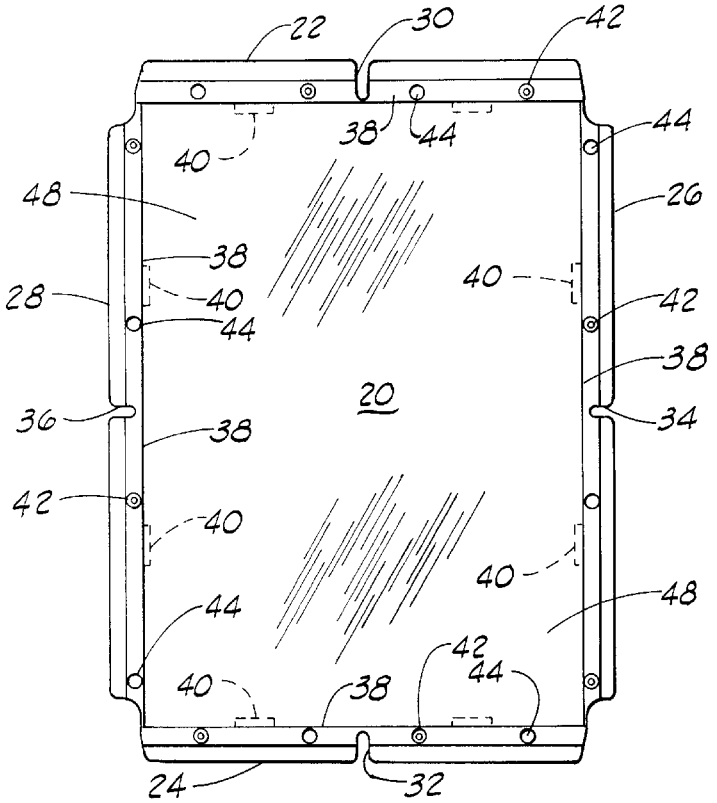
FIG. 3 is a plan view of the inner surface of a second or opposite window panel module.

Referring to FIGS. 2 and 3, each of the window panels 16 consists of opposite side window modules 18 (FIG. 2) and 20 (FIG. 3) of identical size and configuration. Thus, the module 18 is a flat formation molded from clear acrylic polymer to define a cornerless rectangle having top edge 22, bottom edge 24 and opposite side edges 26 and 28. The top edges 22 and 24 include respective guide slots 30 and 32 at their mid-point and, in like manner, the opposite side edges 26 and 28 have respective mid-point guide slots 34 and 36. A raised frame rim or upset 38 of approximately 0.0125 inches height relative to the inner plane of window module 18 is formed in a rectangle around the periphery of module 18. The upset 38 is continuously overlaid on the inside of the upper and lower edge formations 22 and 24 and the left and right edge formations 26 and 28.

The outside of window module 18 is mold-formed to include a plurality of cleat formations 40, two per side, arrayed around the inner line projected from frame upset 38. Also arrayed around the inside of upset 38 are a plurality of spaced locking insert posts 42 (two per side) intersticed with a plurality of similarly arrayed holes 44. The window module posts cooperate with the holes in another identical window module when placed in back-to-back relationship with each other. Thus, and referring to FIG. 3, the opposite side window module 20 is identically formed to window module 18 and the positions of locking insert posts 42 and locking holes 44 cooperate when placed back-to-back as in FIG. 4. This way the two window modules 18 and 20 can be assembled together with locking posts 42 retained within opposite locking holes 44 while the opposed rectangular frame upset surfaces 38 abut to define a narrow card space between the opposite viewing surfaces 46 and 48.

Figure 4:
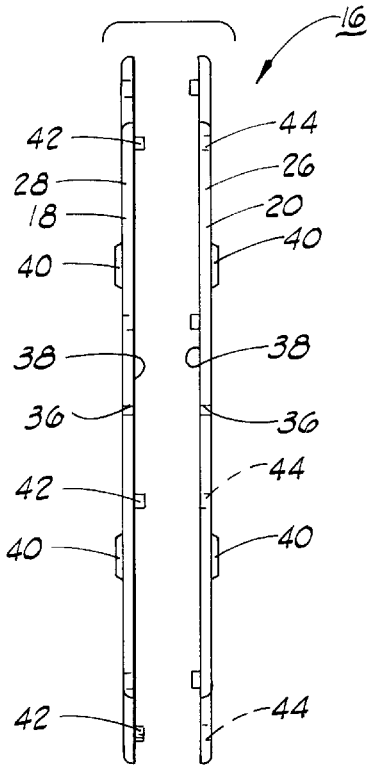
FIG. 4 is a side view of the opposed first and second window panel modules in assembly relationship.

FIG. 4 shows in exploded but aligned form the identical, opposite window modules 18 and 20 poised for closure with opposed frame upset surfaces 38 ready for abutment, and with locking insert posts 42 aligned for insertion within respective locking holes 44. At the same time, the respective guide slots 30, 32, 34 and 36 also line up to aid in further assembly of the frame 10, as will be further discussed.

Figure 5:
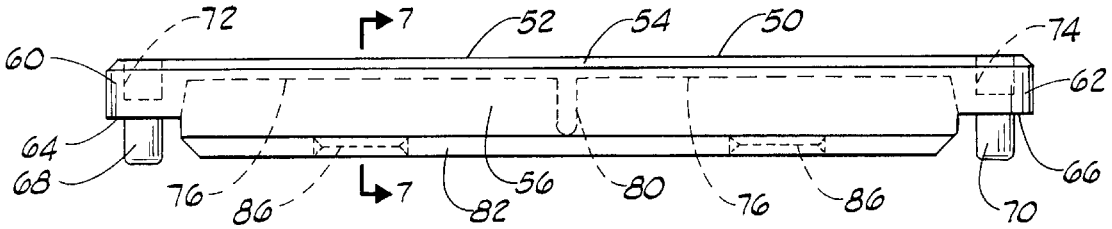
FIG. 5 is a side view of a cap module which forms the top and bottom edge rails of the present invention.
Figure 6:
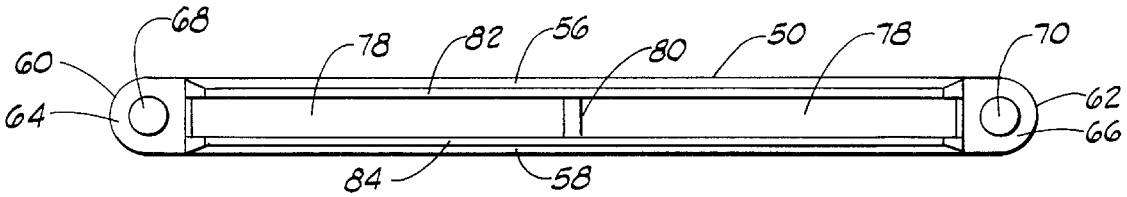
FIG. 6 is a bottom view of a cap module as shown in FIG. 5.
Figure 7:
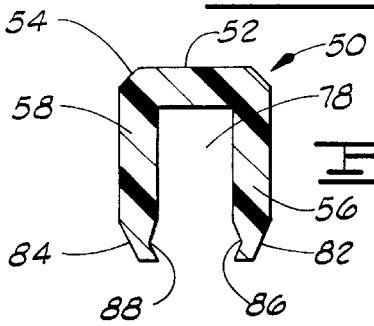
FIG. 7 is a cross section on line 7—7 of FIG. 5.

The top and bottom edges of frame 10 are formed from a cap module 50 as shown in FIGS. 5, 6 and 7. The cap modules 50 are each molded from a suitable plastic of resilient or pliable type such as polyethylene, polypropylene or other commercially acceptable types providing the requisite resiliency. The cap module 50 is an elongated formation having a top 52 and chamfered top edge 54 while extending into opposite sides 56 and 58 (see also FIG. 7). The cap module 50 extends into opposite rounded ends 60 and 62 which define respective shoulders 64 and 66, each parallel to the module top 52. A pair of cylindrical securing posts 68 and 70 are then formed to extend perpendicularly from respective shoulders 64 and 66. Cylindrical stacking holes 72 and 74 are formed in each end of top 52 in alignment with the securing posts 68 and 70.

The inside of cap module 50 is hollowed out as shown by the dash-line 76 (FIG. 5) to define an elongated cavity 78 which is bisected by a transverse guide rib 80. Each side 56 and 58 has a lower bevel edge 82 and 84, respectively, for the purpose of receiving the upper or lower edge of the window panel 16 (window modules 18 and 20) smoothly therein with necessary engagement of guide rib 80 within a respective upper or lower guide slot 30 or 32 (see FIG. 2). Further, a plurality of cleat holes 86 and 88 (FIG. 7) are formed along the inside edges of respective bevel edges 82 and 84 for the purpose of meshing with respective cleats 40 (FIG. 2) on the respective window module structures 18 and 20.

Figure 8:
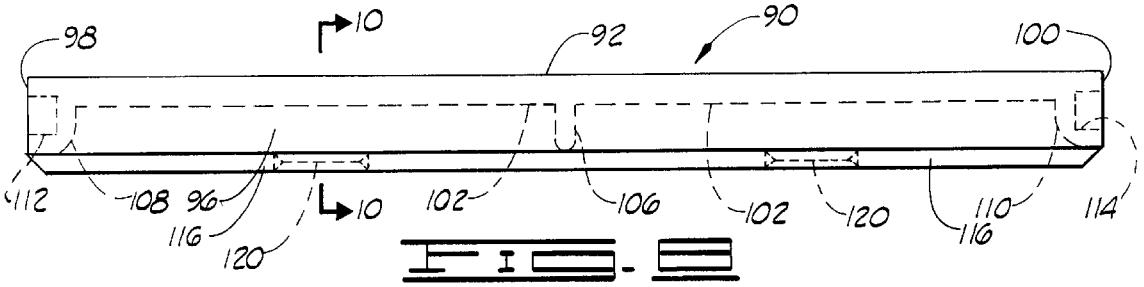
FIG. 8 is a side view in elevation of a side module which forms the opposite side edge rail.
Figure 9:
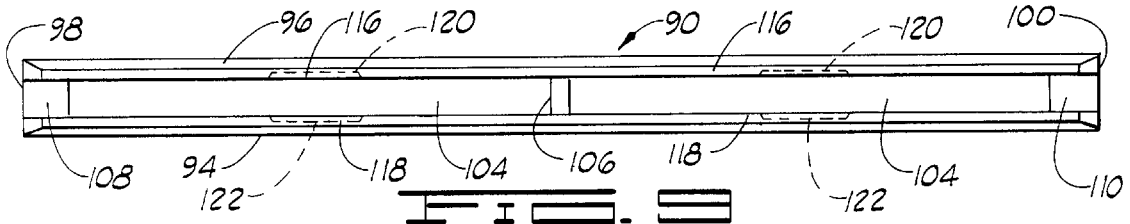
FIG. 9 is a bottom view of a side module.
Figure 10:
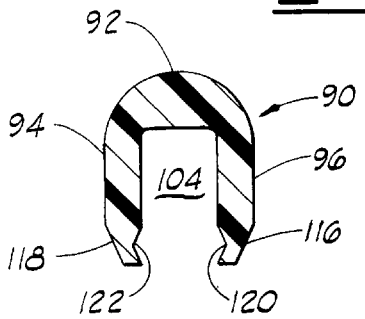
FIG. 10 is a section taken along lines 10—10 of FIG. 8.

A side module 90 as shown in FIGS. 8, 9 and 10 constitutes the opposite side edges of the frame 10. The side module 90 is an elongated piece having rounded top 92 and opposite sides 94 and 96 with right angle ends 98 and 100. The side module 90 is hollowed out as indicated by the dash-line 102 to form an elongated cavity 104 that is bisected by a guide rib 106. An end wall 108 and 110 defines the inner wall of opposite module ends 98 and 100. Respective cylindrical holes 112 and 114 are formed longitudinally with and in axial alignment within the module ends 98 and 100 for the purpose of providing a securing point for respective ones of cap module cylindrical posts 68 and 70 (FIG. 5) during frame assembly. The bottom of the side module 90 also includes aesthetically pleasing bevels 116 and 118 along the lower sides of respective sides 96 and 94. Also, a plurality of cleat holes 120 and 122 are formed along the inner edge of the bevel portions of respective sides 96 and 94 to provide gripping seating with respective cleats 40 on window panel 16 (see FIG. 2).

Figure 11:
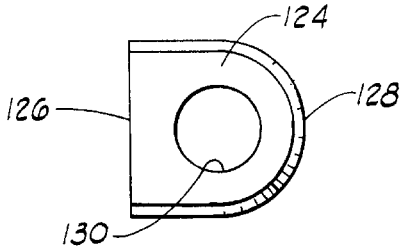
FIG. 11 is a plan view of a corner finish module.
Figure 12:
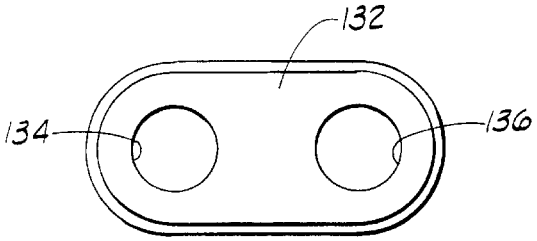
FIG. 12 is a plan view of a hinge module.

FIG. 11 illustrates a finish module for smoothing the corners of a card frame 10 when the corner is to stand singularly. Thus, the corner module 124 is a flat piece having a flat side 126 and the opposite rounded side 128 with a generally central hole 130. The finish module 124 is designed to fit between a cap module 50 and the associated side module 90 as it is positioned over cylindrical post 68 or 70 to effect a smooth corner joint. Alternative to this module 124 is a link or hinge module 132 which is simply an ovate flat piece having post receiving holes 134 and 136 at opposite ends, as shown in FIG. 12. Both the finish module 124 and hinge module 132 have a chamfer about the upper and lower surfaces for the sake of appearance.

Figure 13:
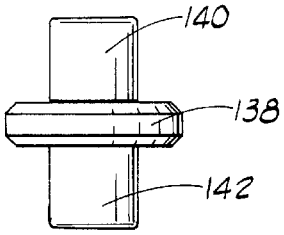
FIG. 13 is a view in side elevation of a stacker module.

FIG. 13 illustrates a stacker module consisting of a chamfered divider disk 138 that extends respective cylindrical posts 140 and 142 from each end in axial alignment. The respective posts 140 and 142 are adapted for insertion within selected ones of insert holes 72 and/or 74 of the upper and lower cap modules 50 (see FIG. 5) to enable stacking of frames in the vertical direction.

Figure 14:
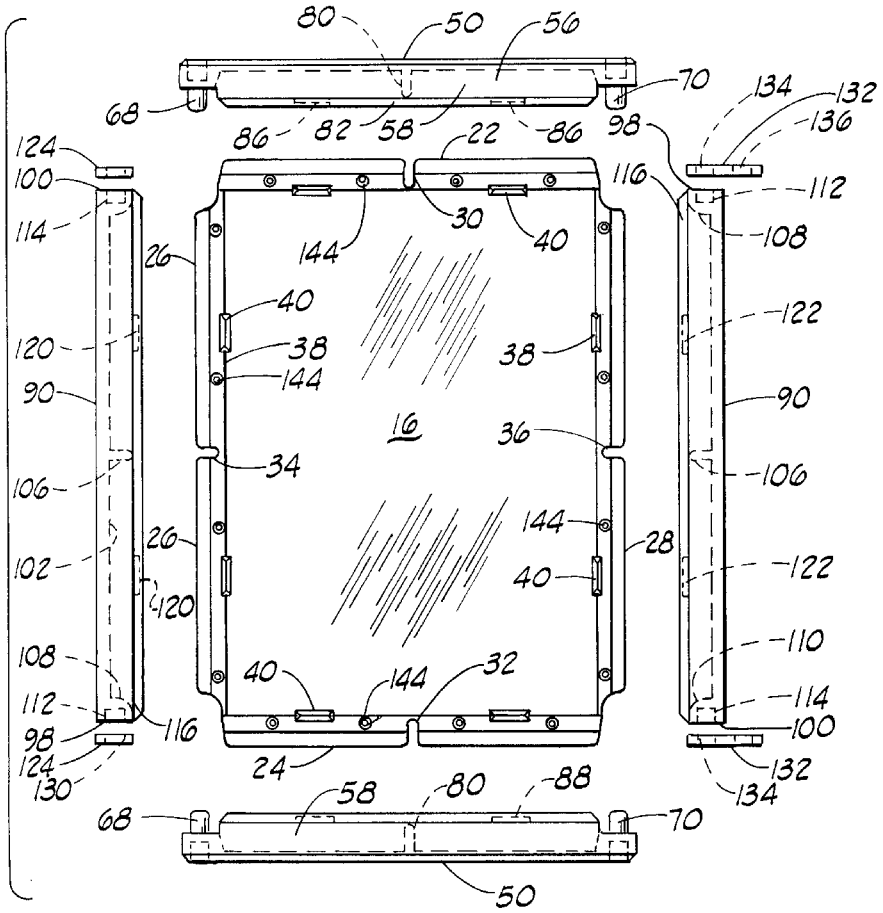
FIG. 14 is a layout plan view in exploded form of a modular card frame.

For discussion of operation, reference is made to FIG. 14. Thus, the double sided window panel 16 is first prepared by placing the sports card or other double-sided viewable within the central space defined by the rectangular upsets 38 on the inner sides of front window module 18 and back window module 20. The window modules 18 and 20 are then squeezed together manually to engage all of respective insert posts 42 within their opposed insert holes 44 thus bringing the opposed upsets 38 into contact thereby to seal the picture material within the central space. Thus each of insert posts 42 and insert holes 44 (FIGS. 2 and 3) are engaged to form a joinder 144 thereby to align and hold together the opposite window modules 18 and 20.

Frame assembly proceeds with opposite side modules 90 being placed over opposite sides 26 and 28 of window panel 16 as the respective opposite side transverse ribs 106 are aligned with the guide slots 34 and 36. When the side module 90 is fully engaged the opposite side window cleats 40 (FIGS. 2 and 3) will engage the respective cleat holes 120 and 122 of side modules 90.

Further assembly calls for placing the top and bottom cap modules 50 over the opposite ends 22 and 24 of the window panel 16. Here again, guide slots 30 and 32 function in coaction with transverse guide ribs 80 of cap modules 50 as the cap modules are forced onto the top and bottom edges 22 and 24 until engagement of the cleats 40 within the array of cleat holes 86 and 88 (see FIGS. 2, 5 and 7).

In the FIG. 14 depiction, the frame selection is to provide a finish corner on the left hand side and a hinge corner on the right hand side. Therefore, finish modules 124 (FIG. 11) are inserted between opposite ends of left side module 90 and the respective upper and lower cap modules 50 to be retained around inserted posts 68 as they engage within upper and lower holes 114 and 112 of side module 90. Hinge modules 132 are selected for the right hand side of frame 10 as a hinge 132 is positioned adjacent the opposite ends 98 and 100 of left side module 90 for secure affixture with engagement of insert posts 70 of upper and lower cap modules 50. The window panel 16 is then fully and compactly held within frame 10 and linkage holes 136 of hinge modules 132 remain free for connection to a next serial frame member. Also, the frame structure may include a stacker module 138 to provide vertical stacking capability for additional frames. The frames 10 can actually be connected in any desired vertical and/or longitudinal array.

Figure 15:
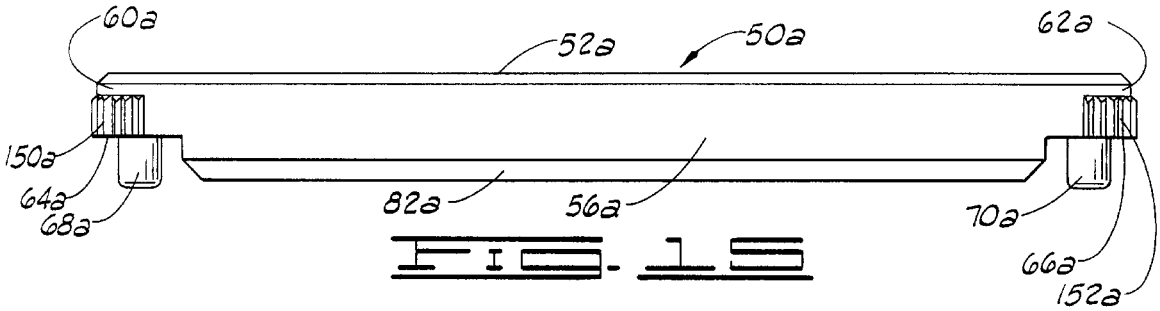
FIG. 15 is an alternative form of cap module.
Figure 16:
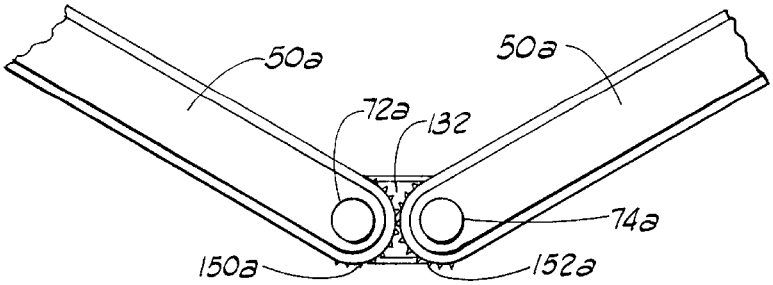
FIG. 16 is a top view depiction of cap modules in engagement.

FIGS. 15 and 16 illustrate an alternative form of the present invention. The card frame 10 as described so far is subject to a wobbly attitude when two card frames 10 are hinged together by means of hinge modules 132 (FIG. 12). This wobbly or uneven hinging is overcome by indexing the relative movement between adjoining card frames and this is effected by using the cap modules 50*a* as shown in FIG. 15. Cap module 50*a* is identical to cap modules 50 (FIG. 5) in every respect except for the addition of molded indexing gear sectors 150*a* and 152*a* on opposite ends 60*a* and 62*a* of cap module 50*a*. Thus, a generally semi-circular gear sector 150*a* and 152*a* is molded to project from the ends of cap module 50*a* immediately above the respective shoulders 64*a* and 66*a*.With the cap modules 50*a* used in adjoining card frames, as shown in FIG. 16, any angular movement of one frame relative to the other will be indexed in accordance with tracking of the gear sectors 150*a* and 152*a* in both the upper and lower cap modules 50*a* forming the card frame 10. Such positive indexing of angular movement eliminates the possibility of wobble or that condition where upper and lower cap modules advance at different angular rates.

The foregoing discloses a novel modular card frame that is particular adapted for construction of two-sided viewing frames, especially such card frames that are desirable for use by collectors and fanciers in general to exhibit trading cards of sports heros, celebrities and the like. The card frame utilizes a novel form of frame joinder as between top, bottom and side frame portions and it further includes novel aspects of structure enabling stacking and/or aligning consecutively of card frames. All elements may be formed of selected plastics for manual assembly to a permanent frame structure.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A frame for pictorial matter, comprising:

front and back viewing panels each formed of clear plastic with inside and outside surfaces, and being interlocked together to have opposite left and right sides, and top and bottom sides forming an outer periphery, said viewing panel being capable of containing said pictorial matter therebetween;

left and right side edge members each formed to have a smooth outer side, front side, rear side and inner side while defining a channel along the inner side, said left and right sides of the viewing panel being closely contained within the respective channels of said left and right side edge members;

top and bottom edge members each formed to have a smooth outer side, front side, rear side and inner side while defining a channel along the inner side, said top and bottom sides of the viewing panel being closely contained within the respective channels of said top and bottom edge members; and means for securing the ends of top and bottom edge members to the ends of respective left and right side edge members to form the corners of a rectangular frame.

2. A frame as set forth in claim 1 wherein:

said left and right side edge members and said top and bottom edge members are formed from a resilient plastic.

3. A frame as set forth in claim 1 wherein said means for securing comprises:

left and right securing posts formed on each end of each top and bottom edge members with said posts directed in parallel and perpendicular to said edge members smooth outer sides; and holes formed on opposite ends of each of said side edge members in alignment with the length of said edge members, said respective end holes receiving a respective securing post tightly therein.

4. A frame as set forth in claim 3 wherein:

said left and right side edge members and said top and bottom edge members are formed from a resilient plastic.

5. A frame as set forth in claim 1 which further comprises:

a plurality of cleats formed around the periphery of the outside surface of said viewing panels; and a plurality of cleat holes formed within the channels of the left and right side edge members and top and bottom edge members for mating engagement with said plurality of cleats.

6. A frame as set forth in claim 5 wherein said front and back viewing panels further include:

a rectangular upset of minimal height formed around each viewing panel inside surface;

a plurality of posts and holes disposed around the upsets to provide interlocking joinder of the front and back viewing panels while the opposed upsets abut to form a sealed cavity for containing the pictorial matter.

7. A frame as set forth in claim 1 wherein said front and back viewing panels further include:

a rectangular upset of minimal height formed around each viewing panel inside surface;

a plurality of posts and holes disposed around the upsets to provide interlocking joinder of the front and back viewing panels while the opposed upsets abut to form a sealed cavity for containing the pictorial matter.

8. A frame as set forth in claim 1 wherein said top and bottom edge members further comprise:

a sector of gear teeth formed around each end of the edge members in a plane parallel to the edge members outer side.

9. A modular rectangular frame for pictorial matter, comprising:

front and back window modules each having front and back sides and a periphery with plural posts and plural holes around the periphery for interlocking engagement when the window modules are aligned back to back to define left, right, top and bottom edges;

left and right side modules each having first and second ends, an outer side, front side, rear side and inner side while defining a channel along the length of the inner side, said left and right edges of the window modules being inserted in the respective channels of said left and right side modules;

top and bottom cap modules each having first and second ends, an outer side, front side, rear side and inner side while defining a channel along the length of the inner side, said top and bottom edges of the window module being inserted in the respective top and bottom cap module channels; and means for securing the top and bottom cap modules to the respective left and right side modules of the rectangular frame.

10. A modular frame as set forth in claim 9 which further includes:

a shallow upset extending peripherally in rectangular shape around the back sides of each window module to form an air exclusive space for containing pictorial matter when the window modules are aligned back to back.

11. A modular frame as set forth in claim 9 wherein the cap modules further comprise:

an integrally formed sector gear disposed around the first and second ends, said gears being coplanar with said cap module.

12. A modular picture frame, comprising:

first and second cap modules having securing posts extending at right angels from opposite ends of the cap modules and defining a channel extending between said securing posts;

first and second side modules having longitudinal holes formed in opposite ends and defining a channel extending between said side module opposite ends; and a window panel formed from two opposed window modules having right and left edges and top and bottom edges and defining a rectangular, closely spaced pictorial matter cavity;

whereby the first and second side modules are placed with channels receiving the right and left edges of the window panel, and first and second cap modules are placed with channels receiving top and bottom edges of the window panel, and first and second cap module securing posts are firmly received in respective first and second side module longitudinal holes.

13. A modular picture frame as set forth in claim 12 wherein said cap module further includes:

first and second securing holes formed at opposite ends in alignment with said opposite end securing posts; and a stacker module having opposite end posts for affixture in at least one of said first and second securing holes to enable frame stacking.

14. A modular picture frame as set forth in claim 12 which further includes:

first and second hinge modules each having first and second securing holes for affixture on the first and second cap module securing posts to hingedly connect another modular picture frame in serial, folding arrangement.

15. A modular picture frame as set forth in claim 12 which further includes:

at least one finish module to be received on the cap module securing posts adjacent said side module securing holes to provide smooth corner appearance.

* * * * *